United States Patent [19]

Orscheln et al.

[11] 4,245,139

[45] Jan. 13, 1981

[54] BRAKE CABLE SWITCH MEANS

[75] Inventors: Donald W. Orscheln, Moberly; Robert L. Heimann, Huntsville, both of Mo.

[73] Assignee: Orscheln Co., Moberly, Mo.

[21] Appl. No.: 60,007

[22] Filed: Jul. 24, 1979

[51] Int. Cl.[3] ..... H01H 17/08

[52] U.S. Cl. ..... 200/52 R; 200/61.18; 200/61.87; 200/161; 340/668

[58] Field of Search ..... 200/161, 153 F, 52 R, 200/61.13, 61.18, 61.89, 61.87; 340/668, 677

[56] References Cited

U.S. PATENT DOCUMENTS

| | | | |
|---|---|---|---|
| 3,798,402 | 3/1974 | Raab | 200/161 |
| 3,838,235 | 9/1974 | St. Germain | 200/61.18 |
| 3,870,846 | 3/1975 | Filip | 200/161 |
| 4,027,130 | 5/1977 | Filip | 200/61.87 |

*Primary Examiner*—J. V. Truhe
*Assistant Examiner*—Morris Ginsburg
*Attorney, Agent, or Firm*—Laubscher & Laubscher

[57] ABSTRACT

A brake cable switch is disclosed for indicating when a cable is tensioned at or beyond a predetermined value, comprising a hollow rectangular housing containing an hermetically sealed chamber, said housing including a flexible top wall having a convex outer surface the axis of which extends longitudinally along the housing, said top wall being biased away from the housing bottom wall, a pair of switch contacts mounted in the chamber for operation between a normal first electrical condition and a second electrical condition, and a pair of fastener devices arranged at opposite ends of the housing for mounting the housing on an untensioned brake cable. The fastener device deform portions of the untensioned cable on opposite sides of the apex of the convex portion of the top wall toward the end portions of the top wall surface, respectively, whereby when the cable tension exceeds a predetermined value, the convex portion of the housing top wall is deformed inwardly to operate the switch contacts to the second electrical condition.

13 Claims, 6 Drawing Figures

BRAKE CABLE SWITCH MEANS

BRIEF DESCRIPTION OF THE PRIOR ART

It is known in the patented prior art to provide cable tension responsive switches, as indicated, for example, by the patents to Raab U.S. Pat. No. 3,798,402, St. Germain U.S. Pat. No. 3,838,235, and Filip U.S. Pat. Nos. 3,870,846 and 4,027,130.

In these known devices, the cable extends completely through aligned openings contained in opposed wall portions of the switch housing, whereby the switch must necessarily be mounted on the cable before the ends thereof are connected with the actuating mechanism and with the device being operated, respectively. Another drawback of this type of cable tension switch is that the chamber which contains the switch contacts is not sealed, and consequently it is impossible to prevent the introduction of dirt and grease within the area adjacent the electrical contacts, thereby deleteriously affecting the reliability of switch operation.

SUMMARY OF THE INVENTION

Accordingly, a primary object of the present invention is to provide an improved cable tension responsive switch, including a housing containing an hermetically sealed chamber in which are mounted a pair of switch contacts normally having a first electrical condition, said housing having a flexible top wall with a convex external surface toward which the cable, when in an untensioned condition, is deformed, whereby when the cable is tensioned, the convex part of the top wall is displaced toward the bottom wall, thereby to operate the switch contacts to their second condition. In the preferred embodiment, the switch contacts are supported by the housing bottom wall and are arranged in vertically spaced relation, the contact adjacent the top wall being a resilient switch contact. Means are provided for adjusting the initial spacing distance between the switch contacts.

According to another object of the invention, spring means are provided for biasing the housing top wall away from the bottom wall. Preferably, the sping means comprises a leaf spring arranged longitudinally within the housing, said leaf spring having a generally U-shaped configuration with downwardly depending legs that are supported by the housing bottom wall for limited longitudinal displacement relative to the housing when the top wall convex portion is displaced inwardly by an increase in cable tension. The housing also includes shoulder means for retaining the leaf spring against lateral displacement relative to the housing.

According to a further object of the invention, the housing is formed of a suitable synthetic plastic material, such as nylon, teflon, vinyl polymer or the like. The housing preferably includes a pair of sections which carry the top and bottom walls, respectively, which sections are permanently joined (by ultrasonic welding, for example) to hermetically seal the housing chamber. The switch contacts are connected with electrical terminals that extend through openings contained in the bottom wall of the housing.

The housing is fastened to an intermediate portion of the parking brake cable by means of a pair of generally annular members arranged at opposite ends of the housing, respectively. The generally annular members have overlapped parallel terminal leg portions that are spaced a distance slightly greater than the diameter of the cable, whereby when the annular member is positioned with its axis normal to the cable axis, the cable may be displaced within the space between the terminal leg portions, whereupon the annular member is pivoted through an angle of 90° to a position parallel with the axis of the cable.

BRIEF DESCRIPTION OF THE DRAWING

Other objects and advantages of the invention will become apparent from a study of the following specification when viewed in the light of the accompanying drawing, in which.

DETAILED DESCRIPTION

Figure 1:
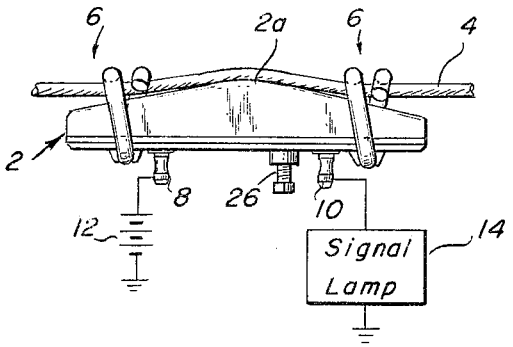
FIG. 1 is a side elevation view illustrating the cable tension switch means of the present invention mounted on a parking brake cable in the untensioned condition.

Referring first more particularly to FIG. 1, the cable tension responsive switch means of the present invention include a housing 2 that is adapted to be fastened to a convenient intermediate portion of an untensioned parking brake cable 4 by means of a pair of generally annular fastening members 6. As shown in FIG. 1, the external top surface of the housing 2 is generally convex relative to the longitudinal axis of the housing 2, the fastening element 6 being operable to deform the untensioned brake cable about the apex portion 2*a* of the convex top housing external surface. The housing 2 is provided with a pair of terminals 8 and 10 for connecting the switch means in series in an electrical indicating circuit including the 12 volt battery 12 and a signal lamp 14.

Figure 4:
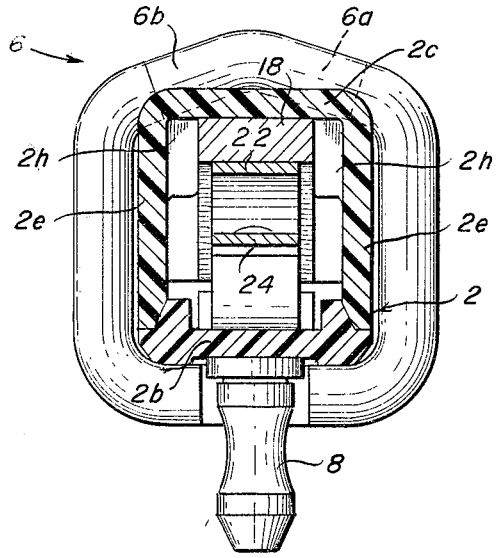
FIG. 4 is a sectional view taken along line 4—4 of FIG. 2.
Figure 5:
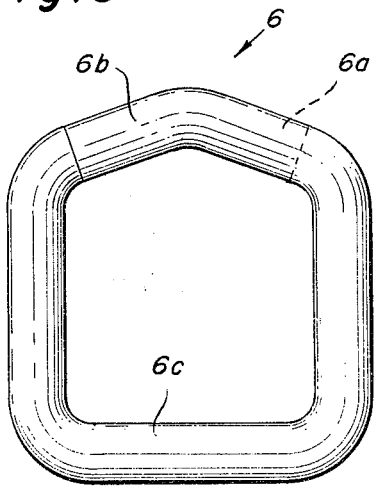
FIGS. 5 and 6 are front and side elevational views, respectively, of the housing fastening means of FIGS. 1–4.
Figure 6:
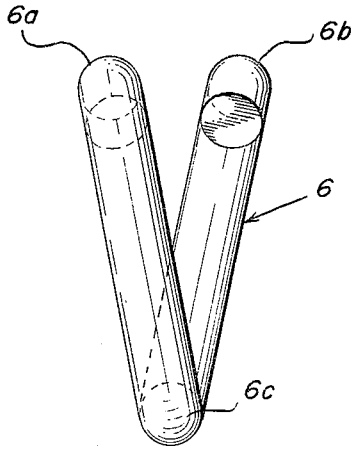
Figure 3:
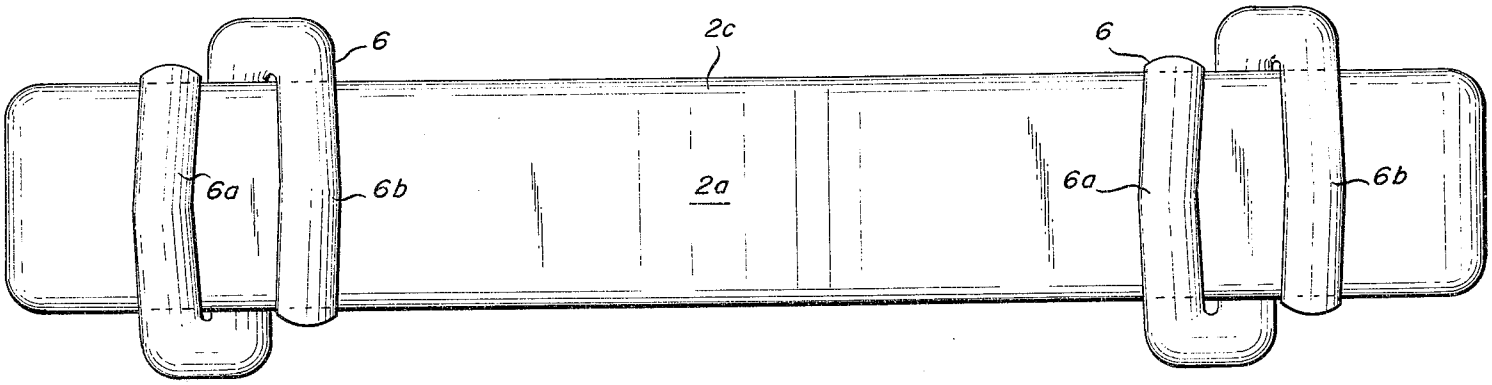
FIGS. 2 and 3 are partially sectioned side elevations and top plan views, respectively, of the cable-operated switch means of FIG. 1.
Figure 2:
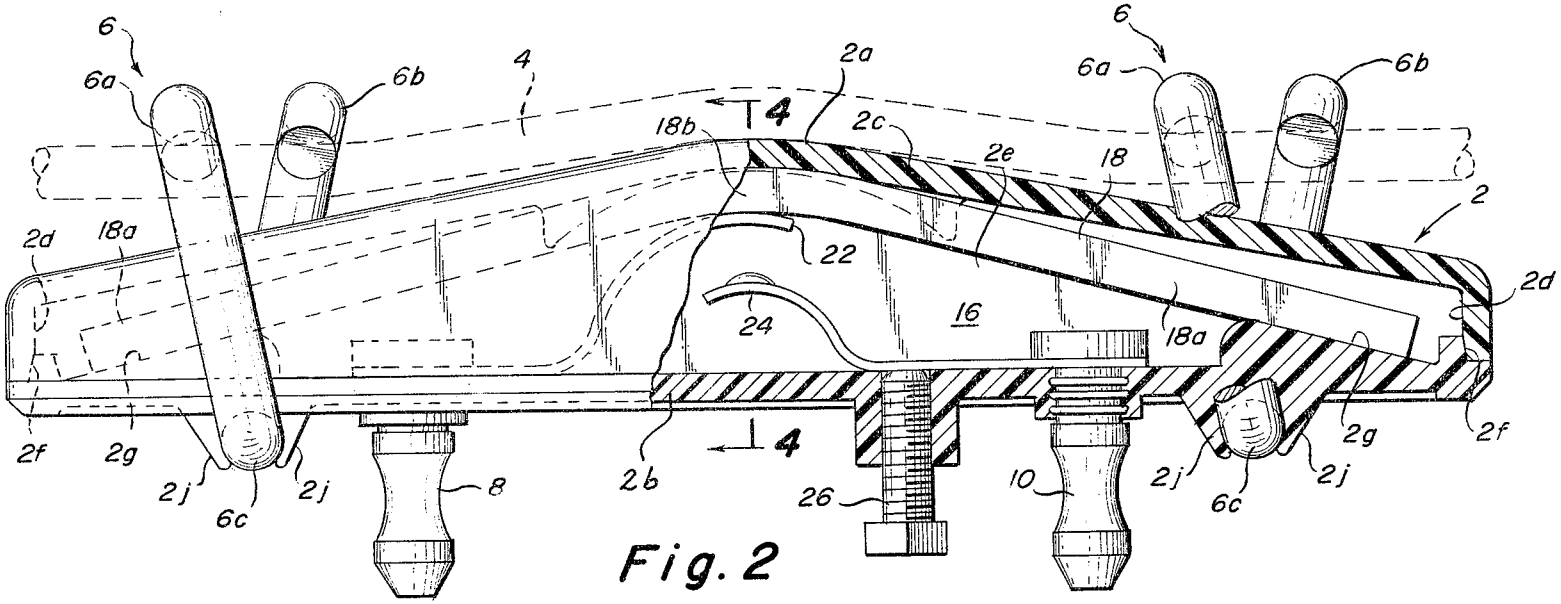

Referring now to FIGS. 2–4, the housing 2, which is formed of a suitable synthetic plastic material (such as nylon, teflon, a vinyl polymer or the like), includes a rigid bottom wall 2*b*, a flexible top wall 2*c*, a pair of end walls 2*d*, and a pair of side walls 2*e*, which walls define within the housing an hermetically sealed chamber 16. As shown in FIGS. 2 and 4, the housing comprises a pair of housing sections one of which carries the flexible top wall 2*c*, the end walls 2*d*, and the side walls 2*e*. The sections are joined by an ultrasonically welded seam 2*f*.

Mounted within the housing chamber 16 is a leaf spring 18 of generally U-shaped configuration, said leaf spring including a pair of leg portions 18*a*, and a bridging portion 18*b*. The housing bottom wall 2*b* includes a pair of inclined supporting surfaces 2*g* that support the spring leg portions 18*a* for slight displacement longitudinally of the housing 2. The bridging portion 18*b* of the leaf spring member supports the central portion of the top wall 2*c*, as shown in FIG. 2, thereby biasing the apex portion of the housing convex top wall 2*c* away from the housing bottom wall 2*b*.

Mounted within the housing chamber 16 are a pair of switch contacts 22 and 24, which switch contacts are flat at one end and are mounted in conductive relation upon the terminals 8 and 10, respectively. At their other ends, the switch contacts extend in vertically spaced relation adjacent the central portion of the housing, whereby the switch contacts are initially in a "switch-open" condition. The switch contacts are formed of a suitable resilient conductive metal or alloy, such as a beryllium-copper alloy. An adjusting screw 26 threadably mounted in a corresponding opening contained in the bottom wall 2b of the housing provides means for vertically adjusting the free end of the lower spring contact 24, thereby to adjust the spacing distance between the contacts when the switch is in its illustrated switch-open condition.

As shown in FIG. 4, the housing includes internal shoulder means 2h that support the leaf spring 18 against lateral displacement relative to the housing 2. The generally angular fastening members 6 extend concentrically about the housing 2, which fastening members 6 include a pair of overlapped spaced terminal portions 6a and 6b. The bridging portion 6c of each of the fastening members is snap-fit between downwardly extending spaced lugs 2j carried by the external surface of the housing bottom wall 2b. As will be set forth in greater detail below, the spacing distance between the terminal leg portion 6a and 6b is slightly greater than the diameter of the parking brake cable 4.

OPERATION

In operation, to mount the switch housing 2 upon an untensioned parking brake cable 4, the cable is positioned parallel to and between the spaced leg portions 6a and 6b of the fastening member 6, whereupon the cable is rotated through an angle of 90° relative to the fastening member 6, whereby the fastener member extends concentrically about the cable and housing assembly. This mounting procedure is then repeated at the other end of the housing. When the housing is fastened to the untensioned parking brake cable 4 as shown in FIG. 4, the cable is slightly deformed about the apex portion 2a of the convex outer surface of the top wall 2c of the housing, thereby to produce a cable deflection of about $\frac{1}{8}''$. The switch contacts 22 and 24 are thus initially in the spaced open-switch condition illustrated in FIG. 2.

Assume now that the parking brake cable 4 is tensioned beyond a desired amount relative to the biasing force of the leaf spring 18. Assuming that the biasing force of the leaf spring is exceeded, the cable 4 is tensioned to its initial linear condition, whereupon the apex portion 2a of the housing top wall 2c is displaced downwardly to displace downwardly both the bridging portion 18b of the leaf spring 18, and the movable switch contact 22. When the movable switch contact 22 comes into engagement with the stationary switch contact 24, the indicating circuit is closed to energize signal lamp 14. During this downward displacement of the central portion of the top wall 2c, The extremities of the leg portions 18a of the leaf spring member slide angularly downwardly to a limited extent upon the inclined support surfaces 2g carried by the housing bottom wall 2b.

When the parking brake cable 4 is returned to the initial untensioned condition, the resiliency of the leaf spring 18 causes the leg portions 18a thereof to be displaced toward each other, thereby elevating the central bridging portion 18b, together with the central portion of the top wall 2c. Owing to the resiliency of the spring contact 22, it is elevated correspondingly to the initial switch-open condition in spaced relation to the lower switch contact 24, thereby opening the indicating circuit to de-energize the signal lamp 14.

As indicated above, the switch housing 2 includes a pair of sections that are permanently joined—for example, by ultrasonic welding—to effect an hermetically sealed chamber 16 within the housing. If desired, the section of the housing containing the rigid bottom wall 2b could be formed from a different synthetic plastic material than the housing section which includes the flexible top wall portion 2c. Furthermore, internal or external strengthening ribs might be provided as required.

It is important to note that owing to the hermetically sealed connection between the housing sections, the chamber 16 is sealed against the introduction of undesirable dirt or grease. The cable tension switch affords an adjustable contact threshold, and the contacts are preferably formed from a beryllium-copper alloy. The housing may be formed from an impact-resistant nylon 6/6 material.

While in accordance with the provisions of the Patent Statutes, the preferred form and embodiment of the invention has been illustrated and described, it will be apparent to those skilled in the art that various changes may be made without deviating from the inventive concepts set forth above.

What is claimed is:

1. Apparatus for indicating cable tension, comprising (a) a generally rectangular housing containing an hermetically sealed chamber and including bottom, top, side and end walls, said top wall being flexible and having, in a direction generally longitudinally along the housing, a convex external surface;

(b) means normally biasing the central portion of said top wall away from said bottom wall;

(c) a pair of switch contacts mounted in said chamber for operation between a normal first electrical condition and a second electrical condition; and (d) fastening means arranged at opposite ends of said housing for attaching the housing, when the top wall surface thereof is adjacent a cable in the untensioned condition, to the cable and for deforming portions of the cable on opposite sides of the apex of the top wall convex portion toward the end portions of the external top wall surface, respectively, whereby when the cable is subsequently tensioned at or beyond a predetermined value relative to said biasing means, the central portion of the housing top wall is deformed toward the bottom wall to operate said switch contacts to their second electrical condition.

2. Apparatus as defined in claim 1, wherein said switch contacts are supported by the housing bottom wall in vertically spaced relation adjacent the center portion of said chamber, whereby the switch contacts are open when in the said first electrical condition.

3. Apparatus as defined in claim 2, wherein the uppermost switch contact adjacent the top wall is resilient.

4. Apparatus as defined in claim 3, and further including switch terminals connected at one end with said switch contacts, respectively, said terminals extending at their other ends outwardly of the housing via openings contained in said bottom wall, respectively.

5. Apparatus as defined in claim 1, wherein said biasing means comprises a spring.

6. Apparatus as defined in claim 5, wherein said spring comprises a leaf spring of generally inverted U-shaped configuration, the leg and bridging portions of said spring being adjacent the bottom and top walls of said housing, respectively, said switch contacts being arranged between the leg portions of said spring.

7. Apparatus as defined in claim 6, wherein said housing includes first shoulder means within said chamber for supporting said leaf spring against lateral displacement relative to said housing.

8. Apparatus as defined in claim 7, and further including means on said bottom wall defining a pair of inclined surfaces supporting said spring leg portions, respectively, for limited longitudinal displacement relative to said housing when the center portion of the top wall is deformed toward the bottom wall.

9. Apparatus as defined in claim 1, wherein said fastening means comprises a generally angular clip member connected at one side with the external surface of said bottom wall, said clip member being adapted to extend concentrically about the housing and the cable when the cable is in its deformed untensioned condition.

10. Apparatus as defined in claim 1, wherein said housing includes at least two sections one of which includes said bottom wall and the other of which includes said top wall, said sections being connected together in hermetically sealed relation.

11. Apparatus as defined in claim 10, wherein at least one of said sections is formed of synthetic plastic material.

12. Apparatus as defined in claim 10, wherein the bottom wall is generally planar, the section including said bottom wall being rigid throughout its length.

13. Apparatus as defined in claim 1, and further including means for adjusting the spacing distance between said switch contacts which said contacts are in the spaced switch-open condition.

* * * * *